US006736595B2

(12) United States Patent
Jinnai et al.

(10) Patent No.: US 6,736,595 B2
(45) Date of Patent: May 18, 2004

(54) ADJUSTABLE NOZZLE MECHANISM FOR VARIABLE CAPACITY TURBINE AND ITS PRODUCTION METHOD

(75) Inventors: Yasuaki Jinnai, Kanagawa-ken (JP); Taro Sakamoto, Kanagawa-ken (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 130 days.

(21) Appl. No.: 10/080,661

(22) Filed: Feb. 25, 2002

(65) Prior Publication Data

US 2002/0119039 A1 Aug. 29, 2002

(30) Foreign Application Priority Data

Feb. 27, 2001 (JP) ..... 2001-052059

(51) Int. Cl.[7] ..... F02B 37/24
(52) U.S. Cl. ..... 415/164; 60/602; 29/889.22
(58) Field of Search ..... 415/164, 163, 415/165, 166, 158, 157, 150, 148, 219 R; 60/602; 29/889.22, 889.21

(56) References Cited

U.S. PATENT DOCUMENTS 4,403,914 A * 9/1983 Rogo et al. ..... 415/165
4,629,396 A * 12/1986 Lorett ..... 415/164
4,657,476 A * 4/1987 Berg ..... 415/48
4,726,744 A * 2/1988 Arnold ..... 417/407
4,741,666 A * 5/1988 Shimizu et al. ..... 415/158
5,518,365 A 5/1996 Baets et al.
5,701,741 A * 12/1997 Halsall ..... 60/602
6,050,775 A * 4/2000 Erdmann et al. ..... 415/164
6,269,642 B1 * 8/2001 Arnold et al. ..... 60/602

FOREIGN PATENT DOCUMENTS

DE 19731715 A1 1/1998
EP 1245307 A2 10/2002

OTHER PUBLICATIONS

Patent Abstracts of Japan, vol. 1998, No. 09, Jul. 31, 1998 & JP 10 089082 A (Toyota Motor Corp), Apr. 7, 1998.

* cited by examiner

*Primary Examiner*—Edward K. Look
*Assistant Examiner*—J. M. McAleenan
(74) *Attorney, Agent, or Firm*—Wenderoth, Lind & Ponack, L.L.P.

(57) ABSTRACT

A variable capacity turbine has adjustment work simplified so as to decrease man-hours, assembly and adjustment costs. The structure is simplified to decrease part category numbers and the number of parts itself, decreasing part costs and enabling nozzle vane setup to a high degree of accuracy without being influenced by the degree of dimensional accuracy of the component parts. A plurality of joint members (lever plates) are used which are the same in number as the nozzle shafts to connect a plurality of nozzle vanes and the nozzle driving member. Each nozzle shaft is fitted and fixed to one end of a respective lever plate after setting the predetermined positional relationship between the wing angle of the nozzle vanes and the predetermined fitting direction of the fixed section of the lever plate. Another end of each lever plate is engaged with the nozzle driving member.

6 Claims, 5 Drawing Sheets

ADJUSTABLE NOZZLE MECHANISM FOR VARIABLE CAPACITY TURBINE AND ITS PRODUCTION METHOD

BACKGROUND OF THE INVENTION

1. Field of Invention

This invention, as used in a supercharger (an exhaust gas turbocharger) of internal combustion engines and so forth, relates to an adjustable nozzle mechanism for variable capacity turbines and its production method, and to a radial flow turbine configured to make an actuating gas flow from the spiral scroll formed in a turbine casing to the turbine rotor through the multiple nozzle vanes having wings of variable angle.

2. Description of the Related Art

In order to make a good match with regard to an internal combustion engine, between the outflow exhaust gas volume from the engine and the actuating gas flow volume which should be determined for the optimum operation condition of the supercharger, variable capacity superchargers, equipped with a variable capacity turbine capable of changing the exhaust gas volume to be sent from the spiral scroll to the turbine rotor in accordance with the operating condition of the engine, have been in widespread use in recent years.

A supercharger with such a variable capacity turbine is equipped with the adjustable nozzle mechanism in order to change the wing angle of the nozzle vane by rotating the nozzle vane with a link assembly so that it is capable of being driven for rotation around the turbine rotor shaft by the actuator through the actuator rod and the driving lever.

For a method of assembly and adjustment of such a variable nozzle mechanism, the invention of Japanese patent number 3,085,210 has been proposed.

In the concerned invention, a jig should be placed at the inner radius of the nozzle vane to perform setup for perfect closing of the nozzle vane and the link assembly to be driven for rotation around the turbine rotor shaft. The jig can be put in contact with the rear edge of the nozzle vane. The stopper pin is mounted after the nozzle vane and the lever plates are welded together upon putting the nozzle vane in contact with the jig in a state that the stopper pin, that is to be fitted into long slots provided at multiple positions along the circumferential direction of the link plate, is made non-functional or non-existing, and upon fitting the matching pin into the phase matching hole to finalize the entire link assembly in the perfect closing phase.

However, problems such as the following are concerns with the invention of Japanese patent number 3,085,210. Two different processes are required, one of which is to put the jig in contact with the nozzle vane in the nozzle vane-free state, wherein the stopper pin to be fitted into the long slots of the link plate is non-functional, and the other is to mount the stopper pin after welding the nozzle vane and the lever plate in the perfect closing phase of the entire link assembly with the matching pin fitted into the phase-matching hole. This in turn requires more assembling jigs, making the adjustable nozzle mechanism assembly and the related adjustment work troublesome, with additional man-hours resulting in a cost increase.

In addition, on the basis of the conventional art in which the structure becomes complex due to the link position determining pin included therein with the stopper pin fitted into the long slot at multiple positions in the circumferential direction of the link plate, the number of the part category and the number of parts themselves will therefore increase considerably. As a result, the device costs will increase accordingly.

Furthermore, as the setup of the total adjustable nozzle mechanism should be carried out by means of fitting the stopper pin into the long slot at multiple positions in the circumferential direction of the link plate and by means of making a match of the relative angle of the contact of the jig at the nozzle vane rear edge against the lever plate, the setup of the perfect closing may vary to cause a setup error. The perfect closing position of the adjustable nozzle mechanism must be determined primarily by the dimensional accuracy of the component parts, which may make it difficult to obtain the proper setup accuracy.

SUMMARY OF THE INVENTION

In consideration of the problems with the conventional art mentioned above, the object of this invention is to propose a method to realize assembly and adjustment, and the related assembly and adjustment facilities for the variable capacity turbine, requiring neither adjustment of the perfect closing position in the nozzle assembly nor the jigs for assembly and adjustment thereof, by which the adjustment work can be simplified to decrease man-hours, as well as assembly and adjustment costs. The structure can also be simplified to decrease part category numbers and the number of parts itself, thus decreasing part costs and furthermore enabling the nozzle vane setup of the adjustable nozzle mechanism to a comparatively high degree of accuracy without being influenced by the degree of dimensional accuracy of the component parts, such as the nozzle vane and the link assembly.

In order to solve the concerned problems, the variable capacity turbine for applying this invention comprises a number of nozzle vanes, which are arranged along the circumference of the turbine and provided on nozzle shafts which are supported on a turbine casing in such a way that the nozzle vanes can rotate, and which vary the vane angle. A nozzle driving member drives the nozzle vanes, and is enabled to rotate around the turbine shaft by an actuator. A turbine rotor is set free for rotation on an inner radial side of the nozzle vanes. The variable capacity turbine is driven for rotation of the turbine rotor by conducting the actuating gas from the scroll in the turbine casing in the inner radial direction through the nozzle vanes to the turbine rotor.

In the event of manufacturing the adjustable nozzle mechanism used in such variable capacity turbine, it is distinguished by a manufacturing method according to this invention, which comprises providing a plurality of joint members (lever plates) which are the same in number as the nozzle shafts, and connecting the plurality of nozzle vanes and the nozzle driving member (link plate), fitting and fixing each nozzle shaft to one end of each lever plate after setting a predetermined positional relationship between the wing angle of the nozzle vanes and the fitting direction of the fixing section of the lever plate; and engaging another end of each lever plate with the nozzle driving member (link plate).

For the concrete fixing method of the nozzle shaft to joint member (lever plate), the method comprises forming a coupling hole in each joint member (lever plate), then forming a flat or curved surface on one sidewall of each coupling hole. A coupling shaft is provided with a fitting surface on the end of the nozzle shaft for nozzle vane, the fitting surface corresponding to the shape of the coupling hole of the joint member (lever plate) for creating a stopper.

The coupling shaft is filled into the coupling hole without causing plastic deformation at the coupling shaft or coupling hole, and a stopper surface of the shaft is engaged with a stopper surface on the coupling hole so that the joint member (lever plate) and the nozzle shaft cannot rotate relatively because of the stopper. Finally, processing for anti-decoupling is carried out to prevent the nozzle shaft from squeezing out of the side surface of the joint members by using the chamfered portion having a larger diameter (chamfered portion) at the edge portion of the nozzle shaft.

The anti-decoupling is preferably done by punching the shaft edge of the coupling shaft by using the chamfered portion at the edge after engaging the coupling hole of the joint member with the coupling shaft of the nozzle shaft. The anti-decoupling process at the edge can be substituted by light welding or the like.

This invention further features that the concrete engaging method of the joint members (lever plate) with the nozzle driving member (link plate) is to fit the slots with the fitting pins equal in number to the joint members. The fitting pins protrude along the circumferential direction on the nozzle driving member. The slots are opened in a nearly radial direction on the other edge of each of the joint members to engage with the fitting pins of the nozzle driving member.

The variable capacity turbine for applying this invention comprises a number of nozzle vanes which are arranged along the circumference of the turbine and provided on nozzle shafts which are supported on the turbine casing in such a way that the nozzle vanes can rotate to vary the vane angle. A nozzle driving member drives the nozzle vanes, and is enabled to rotate around the turbine shaft by the actuator. A turbine rotor is set free for rotation on an inner radial side of the nozzle vanes. The variable capacity turbine is driven for rotation of the turbine rotor by conducting the actuating gas from the scroll in the turbine casing in thinner radial direction through the nozzle vanes to the turbine rotor.

The adjustable nozzle mechanism used in such variable capacity turbine is distinguished by a configuration, comprising a plurality of lever plates which are provided between the nozzle mount and the link plate, one end of each lever plate is fitted and fixed to a respective nozzle shaft after setting a predetermined positional relationship between the wing angle of the nozzle vanes and the fitting direction of the fixing section of the lever plate. The lever plate is provided with a slot which is open in a nearly radial direction on the other edge. The same number of fitting pins protrude from along the circumferential direction and toward the lever plate side on the nozzle driving member, the fitting pins being engaged with the slots of the lever plates.

In accordance with this invention, adjustment of the adjustable nozzle mechanism, that is, the position setup of the wing angle of the nozzle vane and the nozzle driving member, can be made with such an extremely simple process. In this process, the coupling hole provided at one edge of the lever plate and the coupling shaft at the end of the nozzle shaft are fitted after being set up geometrically so that the wing angle and the rotating angle of the link plate composing the nozzle driving member may be in the predetermined relation. The edge of the nozzle shaft is the n punched into one of the chamfered portion of the edge portion in order to be fixed on the lever plate. Then the lever plate and the link plate can be engaged to each other by engaging the pins with the slots provided at the end of the lever plate.

With these simplified processes, adjustment of the adjustable nozzle mechanism during the nozzle assembly procedure is no longer required and therefore the assembly man-hours are decreased, particular assembly facilities such as jigs are not needed, and as a result, assembly costs are decreased. The jigs are still required with the invention of the Japanese patent number 3,085,210 in such a way that the adjustment should be made for the perfect closing position during nozzle assembly procedure by using multiple long slots of the link plate, stopper pin and jigs.

Furthermore, as the adjustable nozzle mechanism according to this invention is configured in a manner that the one edge side of the joint members (lever plate) and the nozzle shaft are fixed upon the set geometrical relations between them and the nozzle driving member (link plate) is joined to the other edge side of each joint member, the structure is simplified as compared with the conventional art, and the number of part categories and parts itself are considerably decreased. Part costs are decreased accordingly.

Furthermore, with this invention, configured such that the nozzle driving member is joined to the other edge of each joint member after the se have been fitted, on the condition that the wing angle of the nozzle vane and the rotating angle of the nozzle driving member (link plate) had been set previously in the geometrical relation as required, and that adjustment of the adjustable nozzle mechanism, that is, the position setup of the wing angle of the nozzle vane and the nozzle driving member is available neither with a setting error that would arise in the conventional art from the variable setup for the perfect closing caused by the adjustment for the perfect closing position during the nozzle assembling procedure using the multiple long slots, the stopper pin and jig, nor the perfect closing position of the adjustable nozzle mechanism should be determined primarily by the component parts, the setup herein of the adjustable nozzle mechanism is available to a high degree of accuracy without fear of influence by the dimensional accuracy of the nozzle assembly and the link assembly, as well as the enabling of the various requirement settings of the adjustable nozzle mechanism.

Still furthermore, with this invention, configured such that the lever plates, equal in number to the nozzle vanes, are placed between the nozzle mount and the link plate in the turbine shaft axis, that the one edge of the lever plate is fixed on the nozzle shaft of the nozzle vane, that the fitting pin protruding toward the lever plate side in the link plate is fitted into the slots on the other edge of the lever plate, that the stopper between the lever plate and the edge of the nozzle shaft is processed with the use of the chamfered portion in order to prevent the stopper portion from squeezing out of the side face of the lever plate, it becomes possible to assemble the link plate and lever plate with a minimum distance. Therefore, the distance between the link plate and the nozzle mount over the lever plate sandwiched thereby becomes shorter, and the length in the shaft axis direction of the adjustable nozzle mechanism is, as a result, shortened.

Still furthermore, the punched portion avoids protrusion from the link plate side, and erroneous operation of the adjustable nozzle mechanism by the friction and interference between the link plate and the punched portion is also avoided.

DETAILED DESCRIPTION OF THE PREFERRED EMBODIMENTS

In the following section we shall give a detailed explanation of the invention with reference to the drawings. In so far as the circuit components, control state, relative position of circuit components, or other features of the constitutive circuitry disclosed in this embodiment are not exhaustively delineated, they are not intended to limit the scope of the invention, but serve merely as examples to clarify the explanation.

Figure 8:
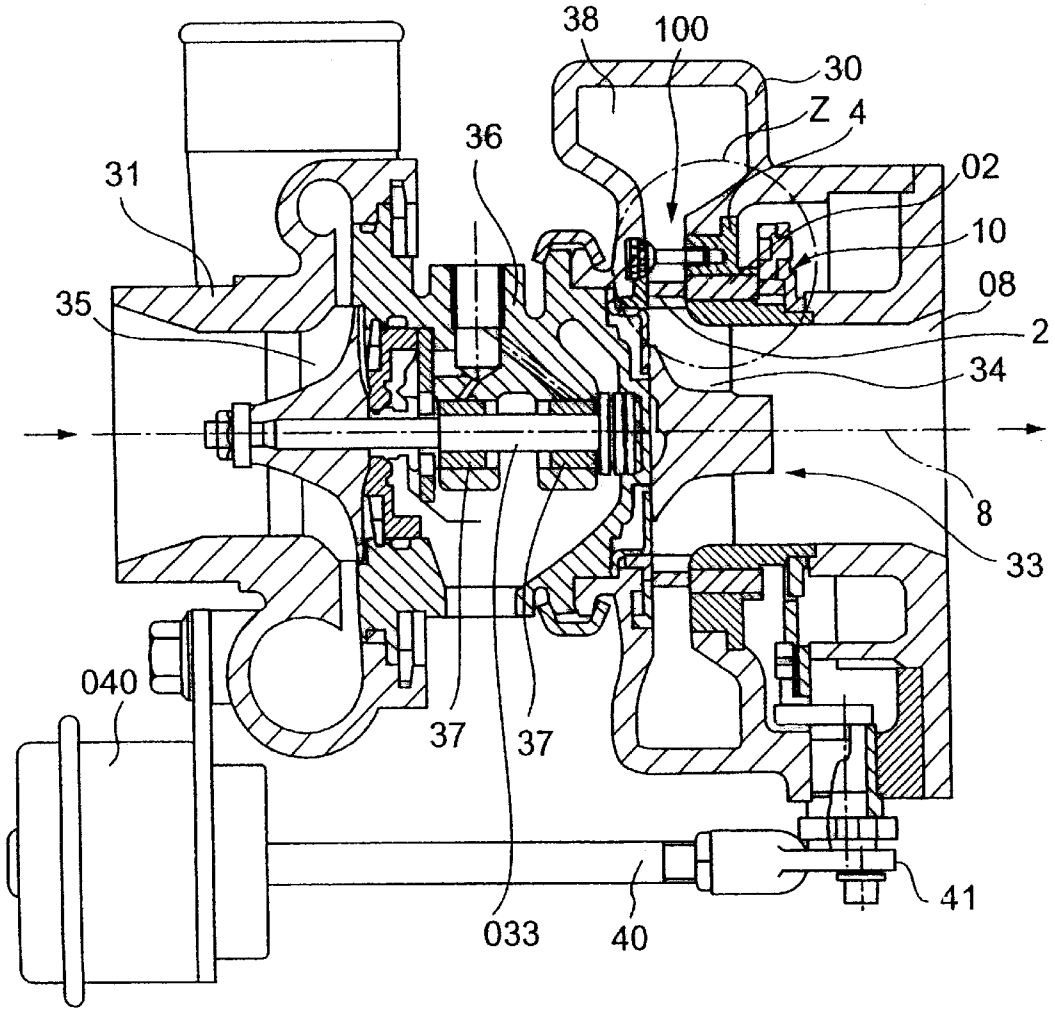
FIG. 8 shows a key cross-sectional view along a rotor shaft of a supercharger with a variable capacity turbine to which this invention is applicable.

In FIG. 8 showing the entire structure of the supercharger with variable capacity turbine to which this invention is applicable, 30 is a turbine casing and 38 is a scroll formed in spiral around the circumference section in the turbine casing 30. 34 is a turbine wheel, 35 is a compressor wheel, and 033 is a rotor shaft to join the turbine wheel 34 to the compressor wheel 35, both of which compose the turbine rotor 33.

08 is an exhaust gas outlet sending out the exhaust gas having done the expansion work in the turbine rotor 33. 31 is a compressor casing and 36 is a bearing housing to join the compressor casing 31 and the turbine casing 30. 37 is the bearing supporting the turbine rotor 33 as mounted on the bearing housing 36.

2 are nozzle vanes, placed equidistantly in multiple along the circumferential direction of the turbine on the inner radius of the scroll 38. A nozzle shaft 02 is formed with each vane and is supported for rotary motion by a nozzle mount 4 fixed on the turbine casing 30. The wing angle of each vane 2 is thus changeable.

40 is an actuator rod, that is, the output end of an actuator 040 to drive the nozzle vane 2. The reciprocating motion of the actuator rod 40 is converted through a known link mechanism including a driving lever 41 into the rotating motion to be transferred to a link plate 3 of an adjustable nozzle mechanism 100 described later.

In the supercharger with the variable capacity turbine of such composition, the exhaust gas from the internal combustion engine (not shown in figures here) flows into the scroll 38 and goes around along the spiral of the scroll 38 further to the nozzle vane 2. The exhaust gas runs through the wings of the nozzle vane 2 to flow into the turbine rotor wheel 34 from the outer radius side thereof. After flowing in a radial direction towards the shaft axis to perform expansion work, the exhaust gas flows in the direction of the shaft axis to the outside from the exhaust outlet 08.

100 is the adjustable nozzle mechanism rotating the nozzle vane 2 in order to change the wing angle thereof by use of the link plate 3 driven in rotation around the rotating shaft 8 of the turbine rotor 33 through the link mechanism, including the actuator rod 40 and the driving lever 41 from the actuator 040. This invention relates to a production method of such an adjustable nozzle mechanism and the structure of the adjustable nozzle mechanism 100 produced by such a method.

In FIGS. 1 to 7 showing the preferred embodiments of this invention, 3 is the link plate formed as a disk, and is joined to the actuator rod 40 for rotating motion around the rotating shaft 8 through the link mechanism including the driving lever 41 as described above.

Figure 5:
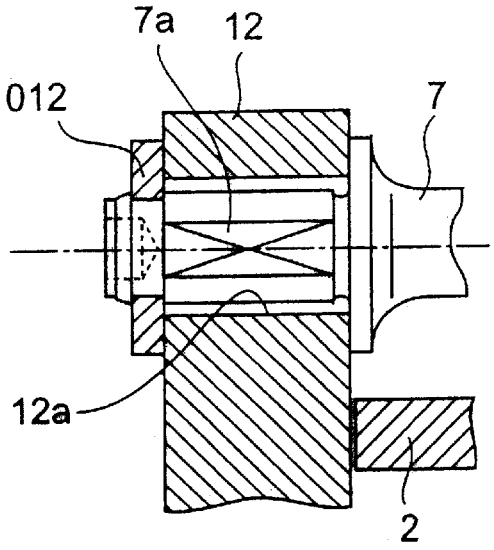
FIG. 5 shows a detailed cross-sectional view of an X section in FIG. 1.
Figure 7:
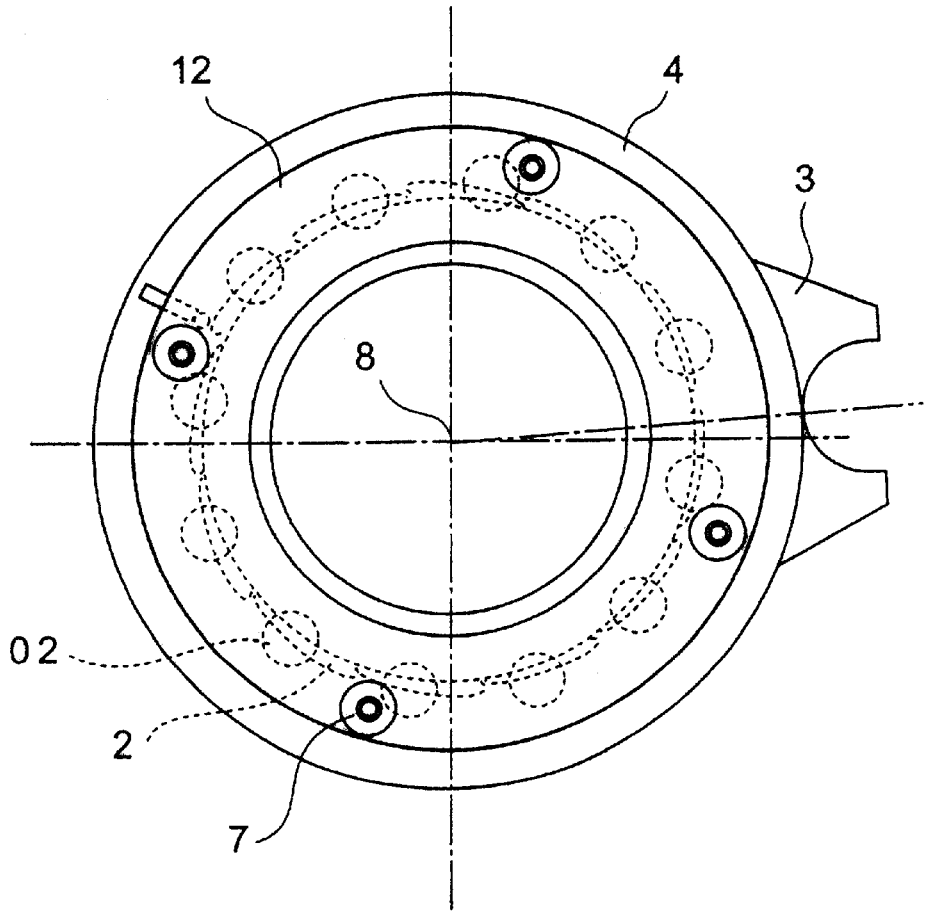
FIG. 7 shows a B-arrow view from FIG. 1.

4 is the ring-shaped nozzle mount fixed on the turbine casing 30. 7 is a nozzle support, four of which (or any plural number of which) are placed along the circumferential direction between the nozzle mount 4 and a nozzle plate 12 as shown in FIG. 7 to fix the nozzle mount 4 and the nozzle plate 12. The coupling section on the nozzle plate 12 side of the nozzle support 7 is processed for a detent function by fitting a parallel shaft section 7*a* formed at a shaft edge section of the nozzle support 7 into a parallel hole section formed in a hole 12*a* of the nozzle plate 12, as shown in FIG. 5, to punch and fix the shaft edge of the nozzle support 7 on the nozzle plate 12 through a washer 012.

On the other hand, the nozzle vane 2 is placed at a radially inner side of the nozzle support 7 between the nozzle mount 4 and the nozzle plate 12. The nozzle shaft 02 fixed thereon (or formed into the nozzle vane 2) is supported for rotating motion.

1 are the lever plates to compose the joint members joining the link plate 3 to the nozzle shaft 02 for each nozzle vane 2. They are placed equal in number to the nozzle vanes 2, where one edge side thereof is fixed on the nozzle shaft 02 and the other edge side is joined to the link plate 3, as described later.

Figure 1:
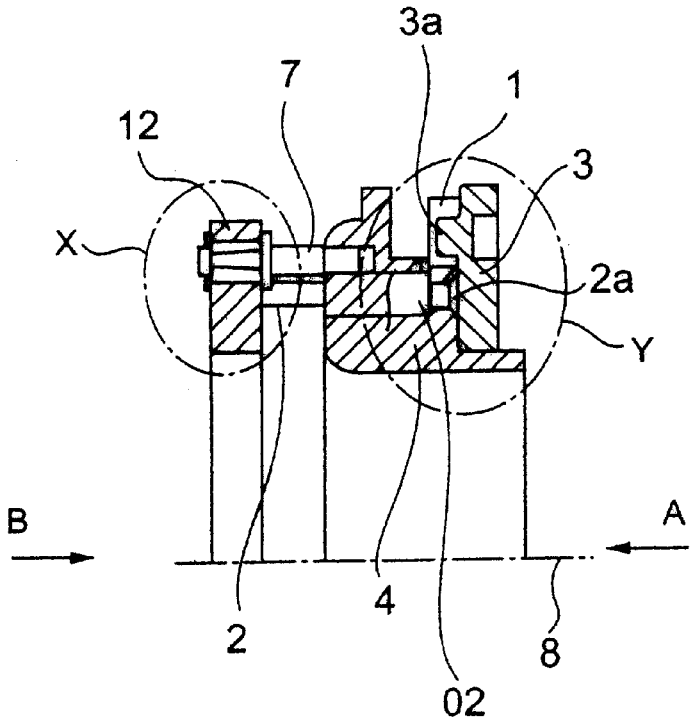
FIG. 1 shows a cross-sectional view along a rotor shaft of an adjustable nozzle mechanism for a supercharger with a variable capacity turbine in connection with this invention, corresponding to a Z section in FIG. 8.
Figure 2:
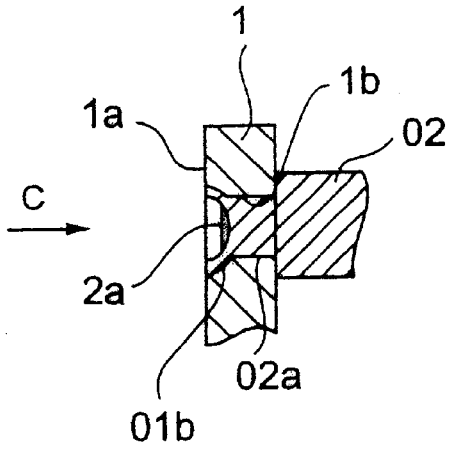
FIG. 2 shows a cross-sectional view corresponding to the Y section in FIG. 1 for a coupling section of a nozzle shaft and lever plate.
Figure 4:
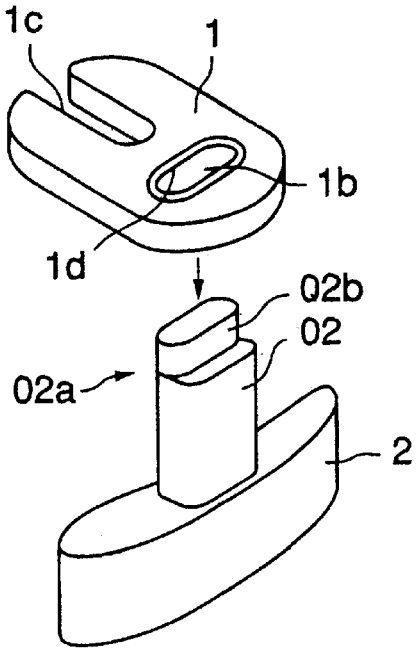
FIG. 4 shows a perspective view of the coupling section of the nozzle vane and the lever plate.

As shown in FIGS. 2 and 4, a coupling hole 1*b* is provided through to the nozzle shaft 02 on one edge side of the lever plate 1. The coupling hole 1*b* forms an oblong shape having a stopper surface in hole 1*d* in parallel the rein onto each of the two opposite surfaces.

On the other hand, a coupling shaft 02*a* is provided to be fitted to the coupling hole 1*b* at the shaft edge of the nozzle shaft 02 of the nozzle vane 2. The coupling shaft 02*a* forms the same oblong shape as the coupling hole 1*b* to be fitted thereto. The stopper surface on shaft 02*b* thereon, in parallel to each other, in attached to the stopper surface in hole 1*d*, the lever plate 1 and the nozzle vane 2 are fitted firmly so as to disable relative rotation.

After the coupling shaft 02*a* is fitted to the coupling hole 1*b*, the edge portion of the coupling shaft 02*a* is processed by punching (at 2*a*) to prevent disconnection, as shown in FIG. 2.

Figure 3:
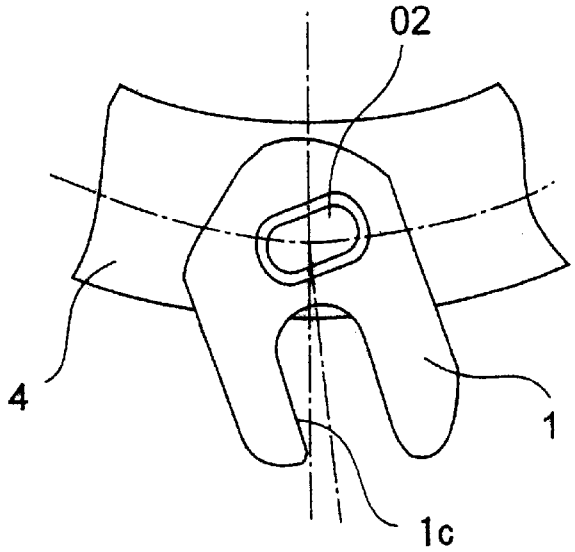
FIG. 3 shows a C-arrow view in FIG. 2.
Figure 6:
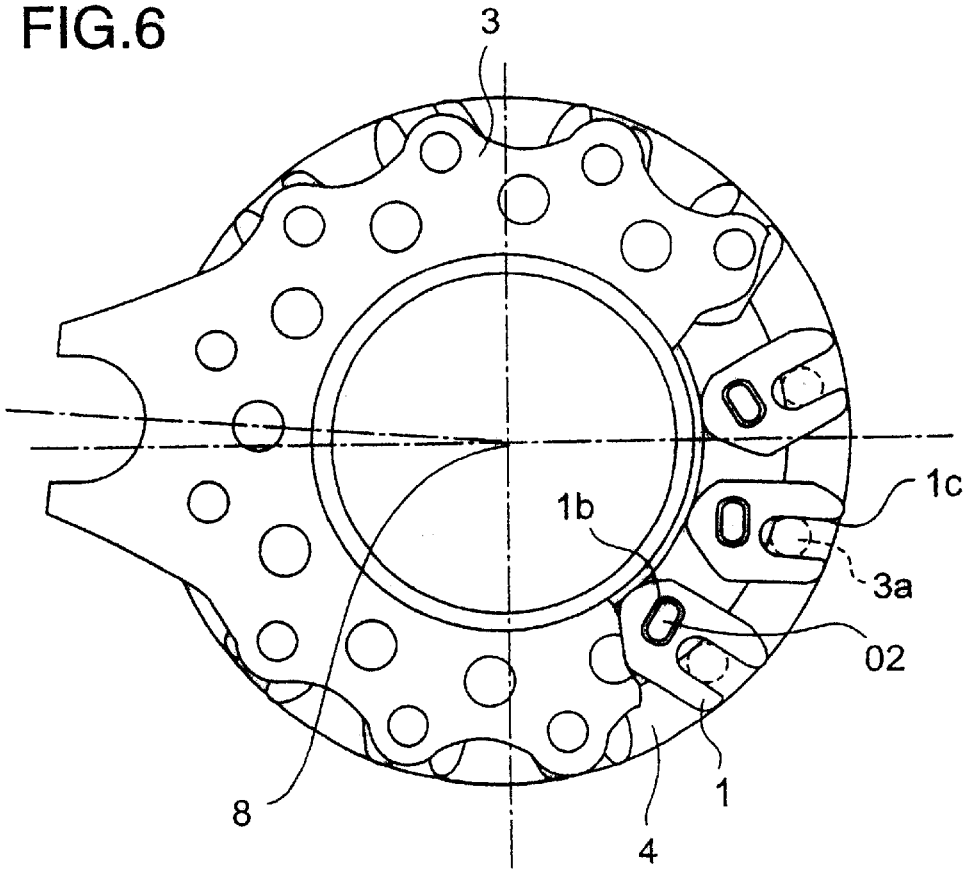
FIG. 6 shows a A-arrow view from FIG. 1.

As shown in FIGS. 3, 4 and 6, on the other edge side of each lever plate 1, slot 1*c* is formed in a radial direction. The slot 1*c* is fitted with a fitting pin 3*a* protruding towards the lever plate in the same quantity as the lever plate 1. The fitting pin 3*a* protrudes towards the lever plate 1 on the side surface of the lever plate 1 from the link plate 3.

The lever plate 1 is placed between the nozzle mount 4 and the link plate 3 in the direction of the turbine shaft axis. As described above, one edge side, that is, an inner radial side, is fixed on the nozzle shaft 02 and the other edge side, that is, an outer radial side, is engaged with the fitting pin section 3*a* of the link plate 3.

In order to control the capacity of the variable capacity turbine equipped with the adjustable nozzle mechanism 100 of such a composition, the wing angle of the nozzle vane 2 should be set up by means of wing angle control (not shown in figures here) to the required flow volume of the exhaust gas flowing through the nozzle vane 2 against the actuator 040. The reciprocating displacement of the actuator 040 corresponding to such wing angle is converted into rotating motion by the link mechanism including the actuator rod 40 and the driving lever 41, and transferred to the link plate 3 to drive the link plate 3 for rotation.

By the rotation of the link plate 3, each lever plate 1, joined by the fitting of fitting pin section 3*a* and slot section 1*c* to the link plate 3, is shaken around the shaft of the nozzle shaft 02 by the shift of the fitting pin section 3*a* in the circumferential direction of rotation by the link plate 3. Then the nozzle shaft 02 is rotated by the rotation of lever plate 1, and the nozzle vane 2 rotates in order to change itself to the wing angle set up by the actuator 040.

When fitting the coupling shaft section 02*a* of the nozzle vane 2 to the coupling hole 1*b* of the lever plate 1 in such an embodiment, the abovementioned stopper surface in hole 1*d* of the coupling hole 1*b* and the stopper surface on shaft 02*b* of the coupling shaft section 02*a* are attached to be fitted after the wing angle of the nozzle vane 2 and the rotating angle of the link plate 3 are set geometrically in the required relation, and the n processed for disconnection prevention by punching the edge of the coupling shaft section 02*a*.

In such a punching process, the outside of the coupling hole 1*b* of the lever plate 1 is chamfered beforehand as shown in FIG. 2 (01*b* showing the chamfered portion) , and after the coupling hole 1*b* of the lever plate 1 and the coupling shaft section 02*a* of the nozzle shaft 02 are fitted, the coupling shaft section 02*a* is punched along the chamfered portion 01*b*. The punching process uses the chamfered portion 01*b* so that the punched part 2*a* at the shaft edge of the coupling shaft 02*a* may not squeeze out towards the inside from the side surface 1*a* of the lever plate 1.

By such a punching process, the punched part 2*a* of the nozzle shaft 02 avoids protrusion from the link plate 3. Erroneous operation of the adjustable nozzle mechanism 100 by friction between the protruding part and the link plate 3 is prevented. The distance in the shaft axis direction of the lever plate 1 from the link plate 3 is made shortest, and therefore the length in the shaft axis direction of the adjustable nozzle mechanism is shortened.

In accordance with such an embodiment, the coupling hole 1*b* (stopper surface in hole 1*d*), formed at one edge side of the lever plate 1, and the coupling shaft section 02*a* (stopper surface on shaft 02*b*) of the nozzle shaft 02 are fitted upon setting beforehand the wing angle of the nozzle vane 2 and the rotating angle of the link plate 3 geometrically in the required relation. Adjustment of the adjustable nozzle mechanism 100, that is, the position setup between the wing angle of the nozzle vane 2*a* and the link plate 3, is carried out by an extremely easy method such that, after the edge of the nozzle shaft 02 (coupling shaft section 02*a*) is punched at the chamfered portion 01*b* to be fixed on the lever plate 1, the fitting pin section 3*a* of the link plate 3 is fitted to the slot 1*c* formed at the other side of the each lever plate 1.

This easy method does not require adjustment of the adjustable nozzle mechanism 100 during the nozzle assembly procedure, in which the perfect closing position should be adjusted during the nozzle assembly procedure by using the multiple long slots of the link plate, the stopper pin and the jigs, as had been required with the invention of Japanese patent number 3,085,210. Therefore, the assembly man-hours are decreased, particular assembly equipment such as the jigs are not needed, and as a result the assembly costs are decreased.

In addition, the adjustable nozzle mechanism 100 is so composed to join the link plate 3 to the other edge side of the each lever plate 1 after setting and fixing the geometrical relation between one edge side of the lever plate 1 and the nozzle shaft 02 as described above. Therefore the structure is comparatively simplified with the above technology, the number of part categories and the parts themselves are considerably decreased, and part costs are decreased accordingly.

Further, in accordance with such an embodiment, adjustment of the adjustable nozzle mechanism 100, that is the position setup between the wing angle of the nozzle vane 2 and the link plate 3, can be carried out by means of joining the link plate 3 to the other edge of the each lever plate 1 after fitting and fixing upon setting up beforehand the one edge of the lever plate 1 and the nozzle shaft 02 geometrically so that the wing angle of the nozzle vane 2 and the rotating angle of the link plate 3 are in the required relation, variations or error may not occur in the setup for the perfect closing, which occurred due to the adjustment to be done with the conventional art for the perfect closing position during nozzle assembling procedure using the multiple long slots of the link plate, stopper pin and jigs. However, with this invention, the perfect closing position of the adjustable nozzle mechanism is not determined primarily by the dimensional accuracy of the component parts, the setup of the adjustable nozzle mechanism 100 is available while securing a high degree of accuracy without being influenced by the dimensional accuracy of the nozzle assembly or the link assembly, and as a result, the adjustable nozzle mechanism 100 can be set up to the various requirements.

Also, in accordance with such an embodiment, as the lever plates 1 equal in number to the nozzle vanes 2, are placed between the nozzle mount 4 and the link plate 3 in the turbine shaft axis direction, one edge side of the lever plate 1 is fixed to the nozzle shaft 02 of the nozzle vane 2, the fitting pin 3*a* protruding on the link plate 3 towards the lever plate side is fitted to the slot provided on the other edge side of the nozzle plate 1, and punching is processed so that the punching portion 2*a* between the lever plate 1 and the shaft edge of the nozzle shaft 02 does not squeeze out over the surface of the lever plate 1. The link plate 3 and the lever plate 1 can be assembled with a minimum gap, the distance between the link plate 3 and the nozzle mount 4 having the lever plate 1 sandwiched thereby is shortened and the length in the shaft axis direction of the adjustable nozzle mechanism 100 is shortened as well.

Furthermore, as described above, erroneous operation of the adjustable nozzle mechanism 100 is prevented due to friction between the protruding part and the link plate 3, as possible protrusion of the punched portion 2*a* of the nozzle shaft 02 from the side of the link plate is avoided.

As mentioned above, according to this invention, adjustment of the adjustable nozzle mechanism, that is, the position setup of the wing angle of the nozzle vane and the nozzle driving member, can be made by such an extremely simple processes. In this process, the coupling hole provided at one edge of the lever plate and the coupling shaft at the end of the nozzle shaft are fitted after being set up geometrically so that the wing angle and the rotating angle of the link plate composing the nozzle driving member may be in the predetermined relation. The edge of the nozzle shaft is the n punched into one of the chamfered portion having a larger diameter (chamfered portion) of the edge portion in order to be fixed on the lever plate. Then the lever plate and the link plate can be engaged to each other by engaging the pin s with the slots provided at the end of the lever plate.

With the se simplified processes, adjustment of the adjustable nozzle mechanism during the nozzle assembly procedure is no longer required and therefore the assembly man-hours are decreased, particular assembling facilities such as jigs are not needed, and as a result, assembly costs are decreased.

Furthermore, as the adjustable nozzle mechanism according to this invention is configured in a manner that the one edge side of the joint members and the nozzle shaft are fixed upon the set geometrical relations between them and the nozzle driving member is joined to the other edge side of each joint member, the structure is simplified comparatively with the conventional art and the number of part categories and parts itself are considerably decreased. Part costs are decreased accordingly.

Furthermore, with this invention, configured such that the nozzle driving member is joined to the other edge of each joint member after the se have been fitted on the condition that the wing angle of the nozzle vane and the rotating angle of the nozzle driving member had been set previously in the geometrical relation as required, and that adjustment of the adjustable nozzle mechanism, that is, the position setup of the wing angle of the nozzle vane and the nozzle driving member is available neither with a setting error that would arise in the conventional art from the variable setup for the perfect closing caused by the adjustment for the perfect closing position during nozzle assembling procedure using the multiple long slots, the stopper pin and jig, nor the perfect closing position of the adjustable nozzle mechanism should be determined primarily by the component parts, the setup herein of the adjustable nozzle mechanism is available to a high degree of accuracy without fear of influence by the dimensional accuracy of the nozzle assembly and the link assembly, as well as the enabling of the various required settings of the adjustable nozzle mechanism.

Still furthermore, with the configuration configured such that the lever plate s equal in number to the nozzle vanes, are placed between the nozzle mount and the link plate in the turbine shaft axis, that the one edge of the lever plate is fixed on the nozzle shaft of the nozzle vane, that the fitting pin protruding toward the lever plate side in the link plate is fitted into the slots on the other edge of the lever plate, that the stopper between the lever plate and the edge of the nozzle shaft is processed with the use of the chamfered portion in order to prevent the stopper portion from squeezing out of the side face of the lever plate, it becomes possible to assemble the link plate and lever plate with a minimum distance. Therefore, the distance between the link plate and the nozzle mount over the lever plate sandwiched thereby becomes shorter, and the length in the shaft axis direction of the adjustable nozzle mechanism is, as a result, shortened.

Still furthermore, the punched portion using the chamfered portion avoids protrusion from the link plate side, and erroneous operation of the adjustable nozzle mechanism by the friction and interference between the link plate and the punched portion is also avoided.

What is claimed is:

1. An assembling method to assemble an adjustable nozzle mechanism used in a variable capacity turbine, wherein the variable capacity turbine comprises:

a plurality of nozzle of vanes arranged along a turbine circumference and provided on nozzle shafts supported on a turbine casing so that the nozzle vanes can rotate and vary their vane angle;

a nozzle driving member for driving the nozzle vanes, the nozzle driving member being rotatable around an axis of the turbine by an actuator; and a turbine rotor that is free to rotate at a position radially inside of the nozzle vanes so that actuating gas flowing from a scroll in the turbine casing and through the nozzle vanes can rotatably drive the turbine rotor;

said method comprising:

fitting and fixing each of the nozzle shafts to one end of respective lever plates after a predetermined positional relationship between the wing angle of the nozzle vanes and a predetermined fitting direction of a fixing section of the lever plates has been set, wherein a coupling hole at the one end of the lever plates and a coupling shaft at an end of the respective nozzle shafts have a geometric relationship prior to said fitting and fixing such that the wing angle and a rotating angle of a link plate of the nozzle driving member are in the predetermined positional relationship after said fitting and fixing; and engaging an other end of each of the lever plates with the link plate of the nozzle driving member.

2. The method of claim 1, wherein said fitting and fixing comprises:

forming the coupling hole in each of the lever plates by creating a non-circular hole having a stopper surface by making two opposite surfaces of the hole parallel, by forming the hole with an oblong shape or by forming the hole with a curved surface on one side wall;

forming a notched coupling shaft having a fitting surface on an end of each of the nozzle shafts, the fitting surfaces having a shape corresponding to the coupling hole of the lever plates for functioning as a stopper;

fitting the coupling shafts into the coupling holes without causing plastic deformation of the coupling shafts or coupling holes and engaging the stopper surface of the coupling holes with the matching fitting surfaces of the notched coupling shafts so that the lever plates and the nozzle shafts cannot rotate relative to each other because of the stopper surfaces and fitting surfaces functioning as stoppers; and processing the nozzle shafts and the lever plates using a chamfered portion of the lever plates having a larger diameter than the notched coupling shafts so as to prevent the nozzle shafts from coming out of the coupling holes and de-coupling from the lever plates.

3. The method of claim 2, wherein said processing comprises punching an end portion of the notched coupling shafts after said engaging the stopper surface of the coupling holes with the matching fitting surfaces of the notched coupling shafts such that the end portion of the notched coupling shafts engages with the chamfered portion of the lever plates and prevents the nozzle shafts from coming out of the coupling holes and de-coupling from the lever plates.

4. The method of claim 1, wherein said engaging comprises fitting slots of the lever plates with respective fitting pins of the driving member, the fitting pins being equal in number to the lever plates, the fitting pins protruding from the nozzle driving member and spaced in a circumferential direction thereof, and the slots being open in a nearly radial direction at the other end of the lever plates to engage with the fitting pins.

5. An adjustable nozzle mechanism used in a variable capacity turbine, wherein the variable capacity turbine comprises:

a plurality of nozzle of vanes arranged along a turbine circumference and provided on nozzle shafts supported on a turbine casing so that the nozzle vanes can rotate and vary their vane angle;

a nozzle driving member for driving the nozzle vanes, the nozzle driving member being rotatable around an axis of the turbine by an actuator having a link plate; and a turbine rotor that is free to rotate at a position radially inside of the nozzle vanes so that actuating gas flowing from a scroll in the turbine casing and through the nozzle vanes can rotatably drive the turbine rotor;

said adjustable nozzle mechanism comprising:

a plurality of lever plates provided between the nozzle vanes and the link plate, wherein one end of each of said lever plates has been fitted and fixed to a respective one of the nozzle shafts after a predetermined positional relationship between the wing angle of the nozzle vanes and a predetermined fitting direction of a fixing section of said lever plates has been set;

a coupling hole at the one end of said lever plates and a coupling shaft at an end of the respective nozzle shafts having a geometric relationship that sets the wing angle and a rotating angle of the link plate of the nozzle driving member in the predetermined positional relationship; and a slot in each of said lever plates being radially outwardly open at the other end of the lever plates and engaging with respective fitting pins on the link plate;

wherein the fitting pins are equal in number to the lever plates, protrude from the nozzle driving member and are spaced in a circumferential direction thereof.

6. The mechanism of claim 5, wherein the coupling hole and the coupling shaft are non-circular.

* * * * *